US005108307A

United States Patent [19]

Cohen

[11] Patent Number: 5,108,307

[45] Date of Patent: Apr. 28, 1992

[54] SUPPORT AND ELECTRICAL CONTROL DEVICE FOR ANIMATED FIGURES

[76] Inventor: Seymour Cohen, 152 Highpond Dr., Jericho, N.Y. 11753

[21] Appl. No.: 651,188

[22] Filed: Feb. 6, 1991

[51] Int. Cl.[5] ..... G09F 19/02

[52] U.S. Cl. ..... 439/502; 40/411; 40/414; 439/557

[58] Field of Search ..... 439/502-506, 439/638, 928, 577; 446/484, 3, 268, 359, 361; 362/808; 40/411, 414, 421, 423, 429-433, 463

[56] References Cited

U.S. PATENT DOCUMENTS

| | | | |
|---|---|---|---|
| 1,349,374 | 8/1920 | Gruenfeld | 362/808 |
| 2,322,668 | 6/1943 | Selvage | 40/414 |
| 2,614,362 | 10/1952 | Zavala | 446/485 |
| 2,722,777 | 11/1955 | Simpson | 40/421 |
| 3,824,524 | 7/1974 | Glover | 439/557 |
| 4,212,007 | 7/1980 | Reyes et al. | 40/414 |
| 4,793,081 | 12/1988 | Andrae et al. | 40/411 |
| 4,989,120 | 1/1991 | Davis et al. | 362/808 |

*Primary Examiner*—Neil Abrams
*Attorney, Agent, or Firm*—Martin Smolowitz

[57] ABSTRACT

A device for support and electrical control of animated figures including an enclosure which is firmly attachable onto a figure and which contains wiring from an electrical power source. A switch and plug are provided in the wiring, and a socket element is attached to a sidewall of the enclosure. If desired, a second device for support and electrical control of a figure can be plugged into the socket unit provided in the first enclosure. Thus, a separate switch exists for each device and when any switch is opened, such as in a stepwise sequence, all the device downstream from that switch are turned off.

1 Claim, 3 Drawing Sheets

SUPPORT AND ELECTRICAL CONTROL DEVICE FOR ANIMATED FIGURES

BACKGROUND OF INVENTION

This invention relates to a device for supporting and controlling one or more animated figures, and pertains particularly to a device for supporting and electrically controlling various motions for an animated figure.

Animated figures such as movable charactericures of animals or persons are generally known, and usually take the form of small animals or persons which are known in folklore, literature or history. However, there have been various problems in providing electrical power to a plurality of such movable figures to achieve animation in a convenient and reliable manner, and also providing appropriate support for such figures. Such problems have now been successfully overcome by the present invention.

SUMMARY OF INVENTION

The present invention provides a device adapted for support and electrical control of animated figures such as charactericures of small animals or persons. The device includes a base enclosure which can be attached firmly to the lower end of such an animated figure, together with necessary circuit elements, i.e. wires, switch, socket, etc. which are adapted for operating and controlling the figure(s). According to the invention, a second device is employed for support and control of another similar animated figure, which second device can be plugged into the socket element of the first device to permit both animated figures to move in response to an electrical signal. For instance, up to six figures and their support device(s) can be so connected together.

The present invention advantageously provides a support and electrical control device adapted to be conveniently utilized as a support means for animated figures and for providing controlled electric power for operation of multiple animated figures. This invention also provides a method for utilizing a plurality of devices for the support and electrical control of animated figures, in which the first device is connected to an electrical power source and the remaining devices are each connected in successive series to one another, so that it is possible to employ all of the devices in a switched condition to result in an animated sequence for the figures so connected.

BRIEF DESCRIPTION OF DRAWINGS

This invention will be described with reference to the following drawings, in which.

DESCRIPTION OF INVENTION

Figure 1:
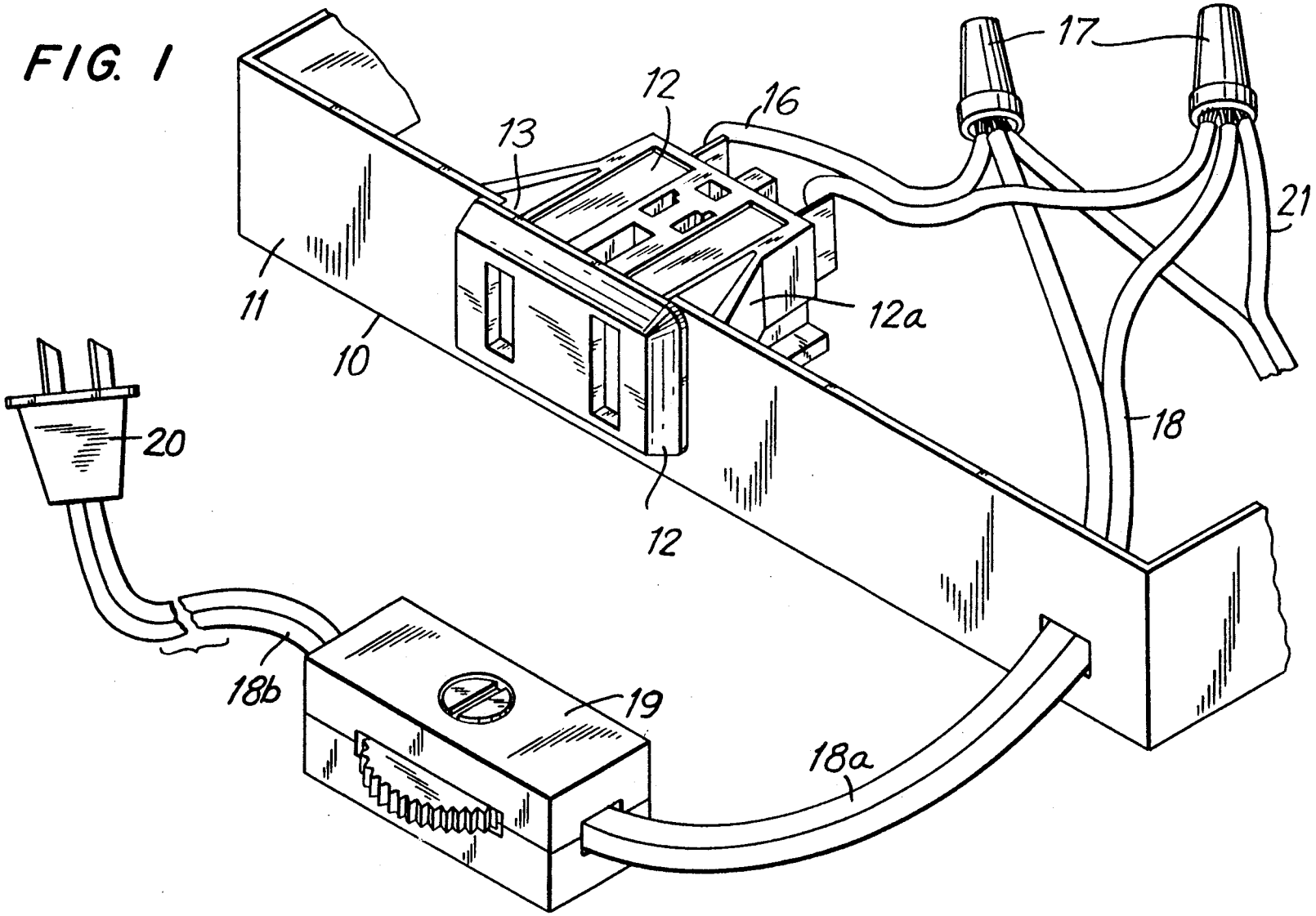
FIG. 1 shows a partial perspective view of an enclosure onto which an animated figure is attached, and which contains an electrical connector and wires.

As shown by FIG. 1, an enclosure 10 has a generally flattened shape and vertical side walls 11. The enclosure 10, which can be either cylindrical or rectangular-shaped, preferably has a height dimension not exceeding about ¼ its minimum width dimension. The enclosure 10 contains a socket element 12 which is attached firmly into an opening 13 in the vertical sidewall 11 by means of dual spring members **12*a* which each spring outwardly to contact the inner surface 11*a* of the wall 11. Dual electrical wires 16 are electrically connected to the rear side of socket element 12, and are electrically connected such as by threaded connector 17 to wire 18, switch 19, and plug element 20 for connection to an electric power source. Also, the wires 21 can be connected by means of threaded connectors 17 and extend upwardly through an opening in the upper side or wall 14 of enclosure 10 to operate an animated figure (not shown) which is mounted on to the upper side of the enclosure 10. Also if desired, any other electrical device can be plugged into the socket element 12**.

Figure 2:
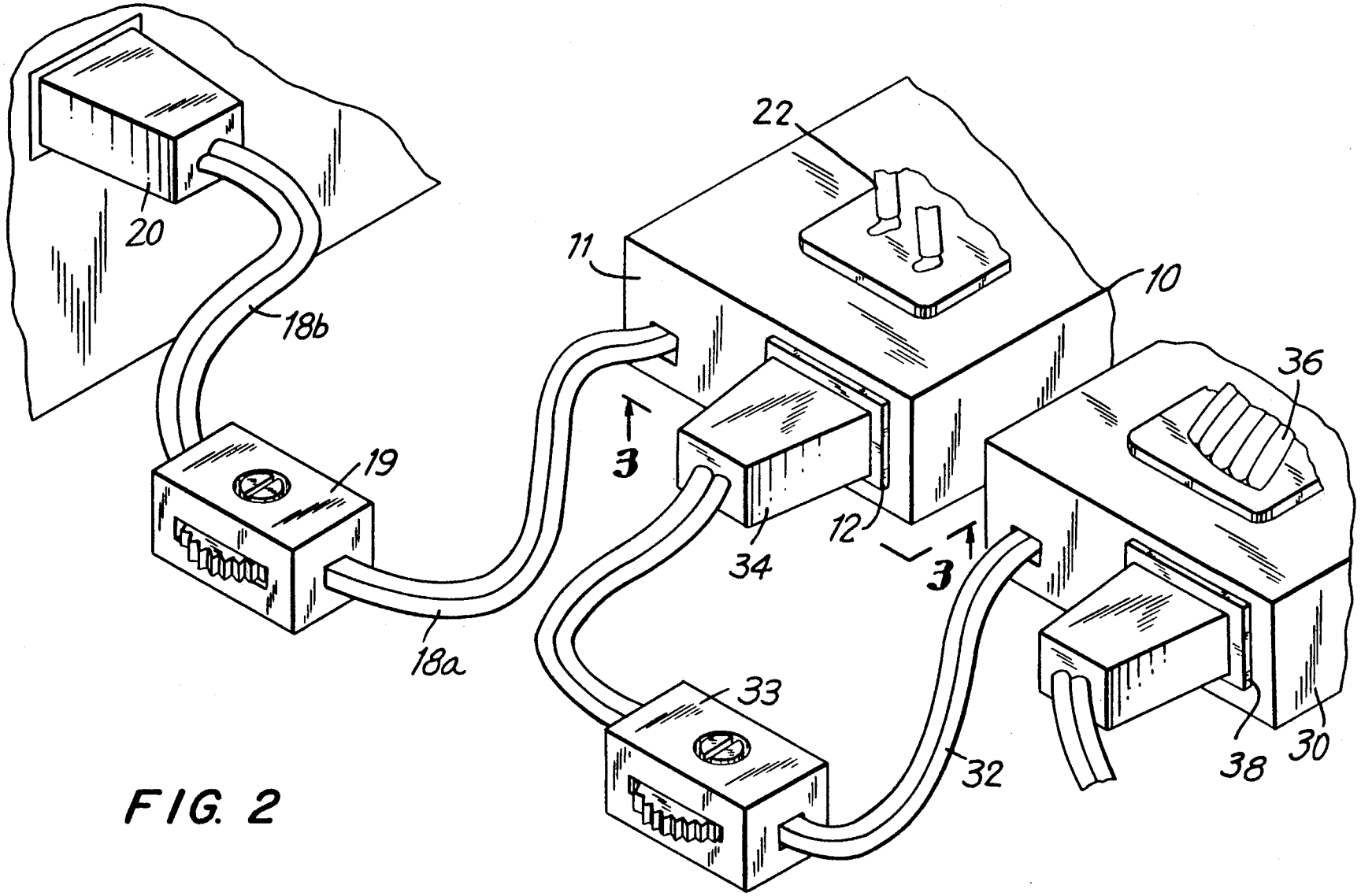
FIG. 2 is another partial perspective view showing multiple enclosures each having an animated figure attached, with electrical connectors and switches connected in a series arrangement.

FIG. 2 shows a FIG. 22 mounted onto the upper side wall 14 of the enclosure 10. Also, a second enclosure 30 is shown connected on to the socket element 12 of the first enclosure 10 by means of conductor wire 32, electrical switch 33, -and plug 34 which is inserted into the socket element 12. A second FIG. 36 is attached firmly onto the upper side wall 31 of the enclosure 30. Also, if desired, a third enclosure and associated figure device having plug 40 can be plugged into a socket element 38 provided in the enclosure 30.

Figure 3:
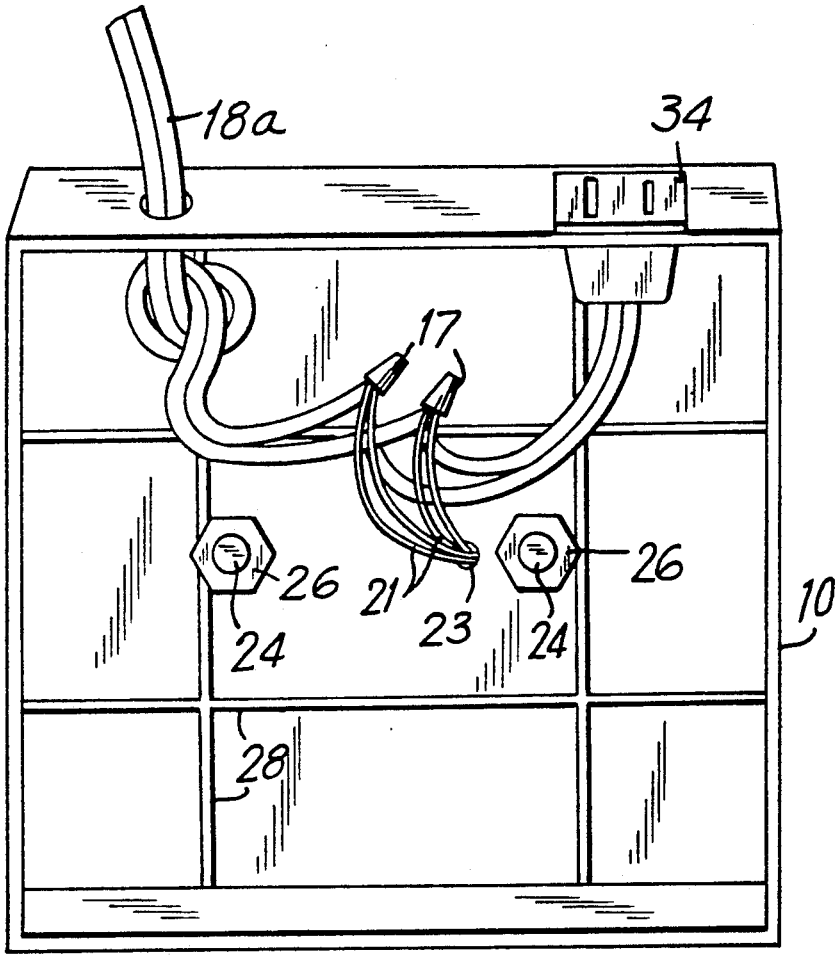
FIG. 3 shows a perspective view looking upwardly in the lower side of the enclosure and taken at line 3—3 of FIG. 2.

As shown by FIG. 3, the enclosure 10 can have a plurality of raised reinforcement ribs 28 provided in the under surface of wall 14 to help maintain adequate rigidity in the wall. The FIG. 22 is attached onto the upper wall 14 of the enclosure 10 by appropriate fastening means such as bolts 24 and nuts 26. As shown by FIG. 3, wire **18*a* is connected by dual threaded connectors 17 onto wires 21 leading upwardly through an opening 23 in upper wall 14 to connect to the FIG. 22**.

The enclosures 10 and 30 are usually made of molded plastic material such as polyethylene, polypropylene or polystyrene. The FIGS. 22 and 36 are made of various plastic structural materials as well as fabric materials.

Regarding utilization of the invention, it is understood that although a single figure and its support and control device can be used alone, as shown by FIG. 1, it is preferred that additional figures and their support and electrical control devices can be attached together in series relationship, as generally shown by FIG. 2. More specifically, a second support and control unit 30 can be plugged into socket 12 of the first unit 10, and a third unit (not shown) can be successively plugged into second unit 30. Thus, when any switch e.g. 33 is opened, such as in a step-wise sequence, all the figures 36 connected downstream from that particular switch are turned off.

Although this invention has been described broadly and in terms of a preferred embodiment, it will be understood that various modifications and variations can be made within the scope of the invention as defined by the following claims.

What is claimed:

1. A method for utilizing a plurality of devices each one being for support and electrical control of animated figures, including the steps of:

connecting a first said device through a switch to an electrical power source; and connecting the remaining said devices each through a switch in a successive step-wise electrical series arrangement, so as to enable use of all of the devices in a switch actuated animated step-wise sequence.

* * * * *